US010132143B2

(12) United States Patent
Romer et al.

(10) Patent No.: US 10,132,143 B2
(45) Date of Patent: Nov. 20, 2018

(54) SYSTEM AND METHOD FOR POWERING AND DEPLOYING AN ELECTRIC SUBMERSIBLE PUMP

(71) Applicants: Michael C. Romer, The Woodlands, TX (US); William A. Symington, Houston, TX (US); Randy C. Tolman, Spring, TX (US)

(72) Inventors: Michael C. Romer, The Woodlands, TX (US); William A. Symington, Houston, TX (US); Randy C. Tolman, Spring, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 208 days.

(21) Appl. No.: 15/204,066

(22) Filed: Jul. 7, 2016

(65) Prior Publication Data

US 2017/0051592 A1 Feb. 23, 2017

Related U.S. Application Data

(60) Provisional application No. 62/209,596, filed on Aug. 25, 2015, provisional application No. 62/208,025, filed on Aug. 21, 2015.

(51) Int. Cl.
*E21B 43/00* (2006.01)
*E21B 43/12* (2006.01)

(52) U.S. Cl.
CPC ..... *E21B 43/128* (2013.01)

(58) Field of Classification Search
CPC ..... E21B 43/128
See application file for complete search history.

(56) References Cited

U.S. PATENT DOCUMENTS

2002/0036085 A1* 3/2002 Bass ..... E21B 17/003 166/250.01

* cited by examiner

*Primary Examiner* — Robert E Fuller
(74) *Attorney, Agent, or Firm* — ExxonMobil Upstream Research Company—Law Department

(57) ABSTRACT

A system for deploying and powering an electric submersible pump within a subterranean well. The system includes a tubing string having a wall forming a hollow interior, one end of the tubing string connected to the electric submersible pump; a flowable conductive material at least partially filling the hollow interior of the tubing string, the flowable conductive material forming a first conductive path; and a second conductive path, wherein the first conductive path and the second conductive path form a circuit for supplying power to the electric submersible pump. A method for deploying and powering an electric submersible pump within a subterranean well is also provided.

23 Claims, 4 Drawing Sheets

SYSTEM AND METHOD FOR POWERING AND DEPLOYING AN ELECTRIC SUBMERSIBLE PUMP

CROSS REFERENCE TO RELATED APPLICATIONS

This application claims the benefit of U.S. Provisional Application No. 62/209,596, filed Aug. 25, 2015, entitled "System and Method for Powering and Deploying an Electric Submersible Pump," the entirety of which is incorporated by reference herein. This application is also related to and claims the benefit of U.S. Provisional Application No. 62/208,025, filed Aug. 21, 2015, entitled "System and Method for Powering and Deploying an Electric Submersible Pump," the disclosure of which is incorporated by reference in its entirety.

FIELD

The present disclosure relates to systems and methods for deploying and powering electric submersible pumps.

BACKGROUND

The utility of electric submersible pumps (ESPs) is sometimes limited by conventional deployment and retrieval methods. A conventional ESP may be installed with a tubing string, requiring a full rig to perform the work. Such installations can be costly, particularly in offshore and remote locations, frequently making ESP installations and retrievals economically prohibitive. As such, a desirable deployment method would avoid the need for a rig and allow the assembled ESP system to be "stripped" into the well through-tubing. Coiled-tubing and cable deployed ESPs have been developed that meet these requirements, but they still have limitations.

The most flexible commercially available coiled-tubing-deployed system employs an internally-installed cable. The cable used is pumped into the coiled tubing, with 10,000 feet the greatest length that vendors have been able to install. A three-phase, No. 2 AWG cable inside of 1¾" coiled tubing represents a typical application. The cable may or may not be anchored inside the coiled tubing, and thermal expansion/contraction effects may be a concern. As may be appreciated, the cable-in-coiled-tubing reel is quite heavy, and lifting operations can challenge offshore cranes; certain platforms may require a support barge for installation. The system cannot easily be spliced, which means the entire string can be lost if there is an issue. Spooling and straightening of the reel can weaken or damage the cable and limit re-use.

Despite these advances, what is needed are improved systems and methods for deploying and powering an electric submersible pump within a subterranean well, which enable deployment at depths greater than about 10,000 feet.

SUMMARY

In one aspect, disclosed herein is a system for deploying and powering an electric submersible pump within a subterranean well. The system includes a tubing string having a wall forming a hollow interior, one end of the tubing string connected to the electric submersible pump; a flowable conductive material at least partially filling the hollow interior of the tubing string, the flowable conductive material forming a first conductive path; and a second conductive path, wherein the first conductive path and the second conductive path form a circuit for supplying power to the electric submersible pump.

In some embodiments, the subterranean well includes a casing and production tubing positioned within the casing, the interior surface of the casing and the exterior surface of the production tubing defining an annular space.

In some embodiments, the tubing string comprises a non-conductive composite material.

In some embodiments, the production tubing forms the second conductive path.

In some embodiments, the tubing string comprises a conductive metallic material, the inner surface of which is coated with an insulating, non-conductive material.

In some embodiments, the tubing string forms the second conductive path.

In some embodiments, the flowable conductive material is selected from lead shot, graphite, mercury, copper, aluminum, or a combination thereof.

In some embodiments, the electric submersible pump has an intake and a discharge and is landed in the production tubing or casing of the subterranean well to seal the intake from the discharge and provide a return electrical conduit.

In some embodiments, the electric submersible pump includes an ESP motor, the ESP motor selected from a two-phase AC ESP motor or a DC ESP motor.

In some embodiments, the system further includes a downhole DC-to-AC inverter for powering a three-phase AC ESP motor.

In some embodiments, the system further includes a third conductive path to power a three-phase AC ESP motor.

In some embodiments, the subterranean well includes a casing which forms an annulus with the tubing string, the tubing string having a filter, a screen, or a check valve to allow a flow path to and from the annulus, wherein the flowable conductive material is prevented from escaping.

In some embodiments, the tubing string has at least one annulus-to-tubing injection valve(s) that permits reverse circulation of the flowable conductive material via an injected fluid.

In some embodiments, the tubing string is structured and arranged to permit entry of a concentric string through which fluids can be pumped to allow reverse circulation of the flowable conductive material.

In some embodiments, the electric submersible pump includes at least one sensor and power is transmitted through the system to power the electric submersible pump.

In some embodiments, a signal is impressed upon the power transmitted to provide a communications link between the electric submersible pump sensors and surface systems.

In some embodiments, the system further includes a wet-mate umbilical pumped to the electric submersible pump through the tubing string forming a dedicated communications link and/or conductive path.

In some embodiments, the wet-mate umbilical includes an internal fluid injection line having an outlet valve(s) that permit reverse circulation of the flowable conductive material.

In yet another aspect, a method for deploying and powering an electric submersible pump within a subterranean well is disclosed. The method includes providing a tubing string having a wall forming a hollow interior, connecting the tubing string to the electric submersible pump; positioning the tubing string and electric submersible pump within the subterranean well; flowing a flowable conductive material to at least partially fill the hollow interior of the tubing string, the flowable conductive material forming a first conductive path; providing a second conductive path; and forming a circuit for supplying power to the electric submersible pump, the circuit comprising the first conductive path and the second conductive path.

In some embodiments, the subterranean well includes a casing and production tubing positioned within the casing, the interior surface of the casing and the exterior surface of the production tubing defining an annular space.

In some embodiments, the tubing string comprises a non-conductive composite material.

In some embodiments, the production tubing forms the second conductive path.

In some embodiments, the tubing string includes a conductive metallic material, the inner surface of which is coated with an insulating, non-conductive material, the tubing string forming the second conductive path.

In some embodiments, the flowable conductive material is selected from lead shot, graphite, mercury, copper, aluminum, or a combination thereof.

In some embodiments, the tubing string has at least one annulus-to-tubing injection valve(s) that permit reverse circulation of the flowable conductive material via an injected fluid.

In some embodiments, the tubing string is structured and arranged to permit entry of a concentric string through which fluids can be pumped to allow reverse circulation of the flowable conductive material.

In some embodiments, the method further includes the step of providing a downhole DC-to-AC inverter for powering a three-phase AC ESP motor.

DETAILED DESCRIPTION

In FIGS. 1-4, like numerals denote like, or similar, structures and/or features; and each of the illustrated structures and/or features may not be discussed in detail herein with reference to the figures. Similarly, each structure and/or feature may not be explicitly labeled in the figures; and any structure and/or feature that is discussed herein with reference to the figures may be utilized with any other structure and/or feature without departing from the scope of the present disclosure.

In general, structures and/or features that are, or are likely to be, included in a given embodiment are indicated in solid lines in the figures, while optional structures and/or features are indicated in broken lines. However, a given embodiment is not required to include all structures and/or features that are illustrated in solid lines therein, and any suitable number of such structures and/or features may be omitted from a given embodiment without departing from the scope of the present disclosure.

Figure 2:
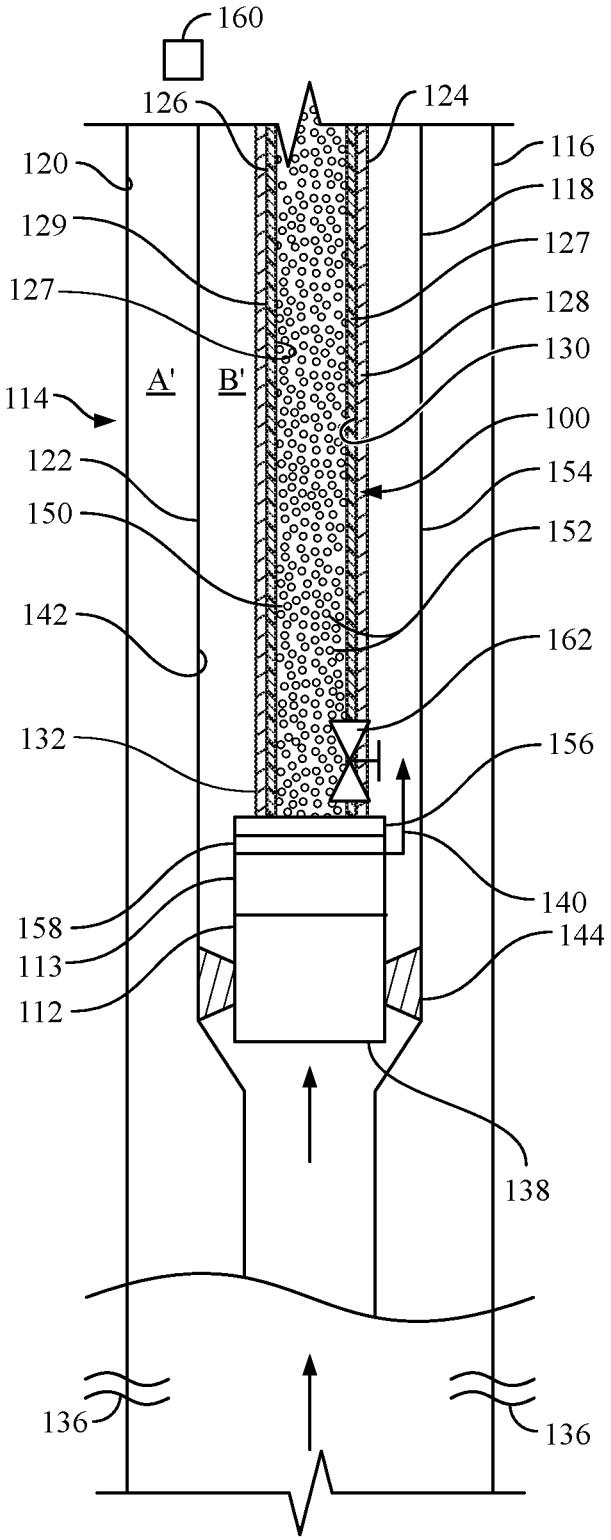
FIG. 2 presents a schematic view of an illustrative, nonexclusive example of a system for deploying and powering an electric submersible pump within a subterranean well, according to the present disclosure.
Figure 3:
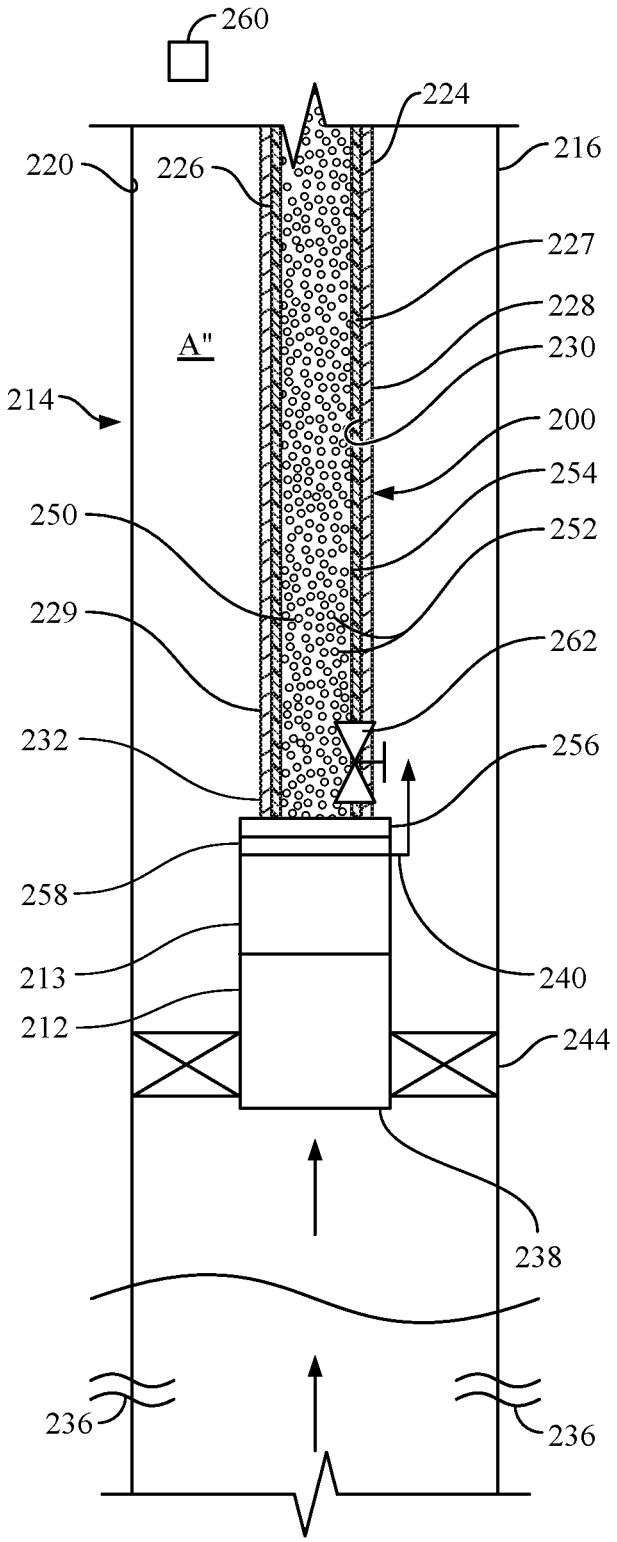
FIG. 3 presents a schematic view of another illustrative, nonexclusive example of a system for deploying and powering an electric submersible pump within a subterranean well, according to the present disclosure, according to the present disclosure.
Figure 4:
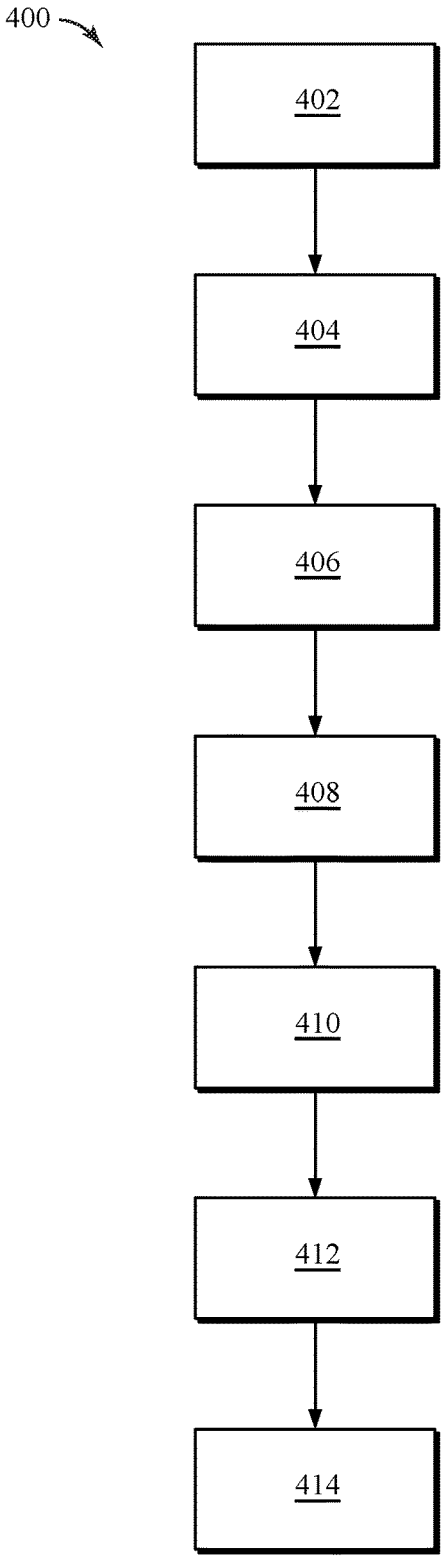
FIG. 4 presents a method for deploying and powering an electric submersible pump within a subterranean well, according to the present disclosure.

FIGS. 2-4 provide illustrative, non-exclusive examples of methods and systems for deploying and powering electric submersible pumps within subterranean wells, according to the present disclosure, together with elements that may include, be associated with, be operatively attached to, and/or utilize such a method or system.

Although the approach disclosed herein can be applied to a variety of subterranean well designs and operations, the present description will primarily be directed to for deploying and powering electric submersible pumps within subterranean wells.

Figure 1:
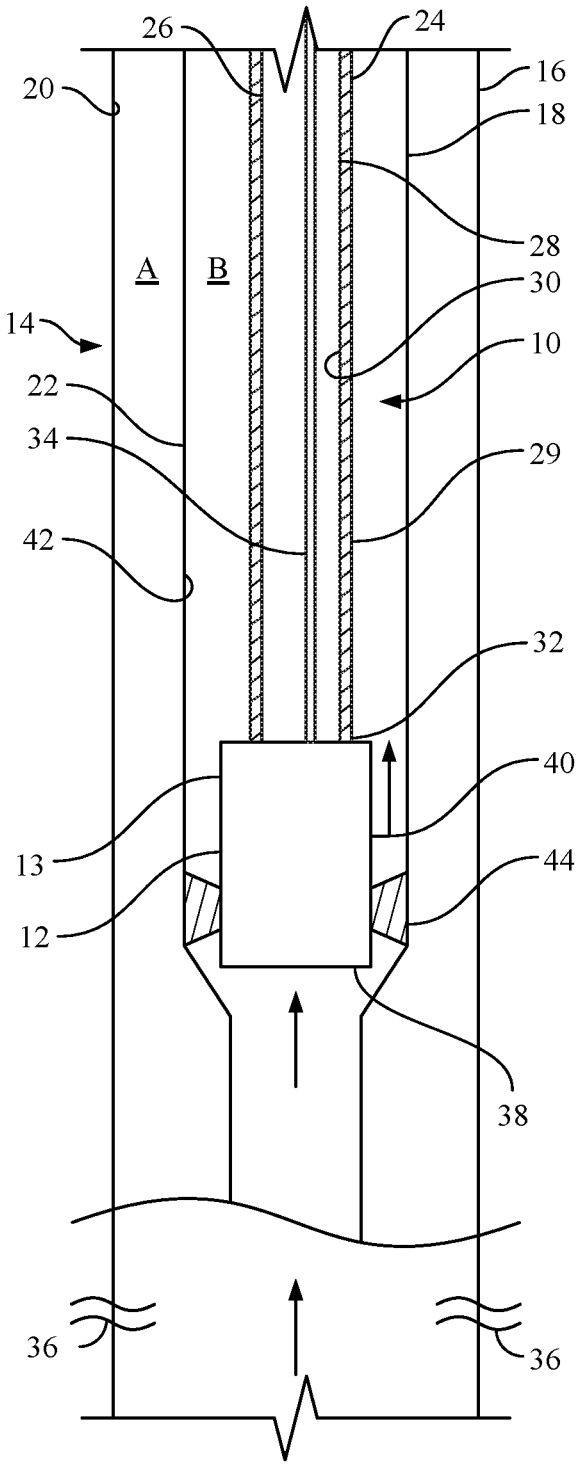
FIG. 1 (Prior Art)
FIG. 1 presents a schematic view of a conventional system for deploying and powering an electric submersible pump within a subterranean well.

FIG. 1 presents, for illustrative purposes, a schematic view of a conventional system 10 for deploying and powering an electric submersible pump 12 within a subterranean well 14. As shown, the subterranean well 14 includes a casing 16 and production tubing 18 positioned within the casing 16. The interior surface 20 of the casing 16 and the exterior surface 22 of the production tubing 18 serve to define an annular space A.

The system 10 includes a tubing string 24, which may be formed from a coiled tubing 26. Tubing string 24 includes a wall 28 forming a hollow interior 30. One end 32 of the tubing string 24 is connected to the electric submersible pump 12.

To provide power to electric submersible pump 12, a conventional cable 34 is installed within the hollow interior 30 of tubing string 24. Cable 34 may be provided with three conductors to power a three phase ESP motor 13 of the electric submersible pump 12. Should a two phase ESP motor 13 be employed, cable 34 may be provided with two or three conductors for supplying power to the ESP motor 13.

Prior to installation of tubing string 24 within the well, the conventional cable 34 may be installed within the hollow interior 30 of tubing string 24 by pumping the conventional cable 34 into the tubing string 24, which may be in the form of a coiled tubing 26. This method of installation is limited to about 10,000 feet in length, the greatest length that suppliers have been able to install. As may be appreciated by those skilled in the art, an installation exceeding this limitation would then require a full rig. This can prove costly, particularly in offshore and remote locations, sometimes making electric submersible pump installations and retrievals economically prohibitive.

In operation, produced fluids enter the well 14 at perforations 36, pass through the production tubing 18, enter inlet 38 of electric submersible pump 12, and are discharged at outlet 40 into the annulus B formed by the inner surface 42 of production tubing 18 and the exterior surface 29 of wall 28 of tubing string 24, exiting at the surface. Seal 44 is installed to direct produced fluids to inlet 38 of electric submersible pump 12.

Referring now to FIG. 2, a schematic view of an illustrative, nonexclusive example of a system 100 for deploying and powering an electric submersible pump 112 within a subterranean well 114 is shown. Subterranean well 114 includes a casing 116 and production tubing 118 positioned within the casing 116. The interior surface 120 of the casing 116 and the exterior surface 122 of the production tubing 118 serve to define an annular space A'.

The system 100 includes a tubing string 124, which may be formed from a composite coiled tubing 126. In some embodiments, composite coiled tubing 126 may be formed from a non-conductive, insulating material. The tubing string 124 may be formed from an internally insulated coiled tubing 126. In some embodiments, internally insulated coiled tubing 126 may be formed so as to have an insulated coating 127 applied to the internal surface of conductive coiled tubing 126. Tubing string 124 includes a wall 128, which forms a hollow interior 130. One end 132 of the tubing string 124 is connected to the electric submersible pump 112.

To provide power to the electric submersible pump 112, a flowable conductive material 150 may be placed so as to at least partially fill the hollow interior 130 of the tubing string 124. As will be described in more detail below, the flowable conductive material 150 may form a first conductive path 152. In some embodiments, production tubing 118 serves as a second conductive path 154, the first conductive path 152 and the second conductive path 154 forming a circuit for supplying power to the electric submersible pump 112.

In some embodiments, the flowable conductive material 150 is selected from lead shot, graphite, mercury, copper, aluminum, or a combination thereof. The flowable conductive material 150 is pumped into the tubing string, either during installation or after landing. A filter/screen and/or check valve 162 at the bottom and/or midpoints of the tubing string 124 may be employed to provide a flow path to annulus B', preventing the flowable conductive material 150 from escaping and providing injection point(s) for reverse circulation of the flowable conductive material.

In some embodiments, the electric submersible pump 112 has an intake 138 and an outlet or discharge 140. In some embodiments, the electric submersible pump 112 may be landed in the production tubing 118, or casing 116, when production tubing 118 is not employed, to seal the intake 138 from the discharge 140 and provide a return electrical conduit.

In some embodiments, the ESP motor 113 is selected from a two-phase AC ESP motor or a DC ESP motor. In some embodiments, the system 100 includes a downhole DC-to-AC inverter 156 for powering a three-phase AC ESP motor. In some embodiments, the system 100 may also include a third conductive path to power a three-phase AC ESP motor.

In some embodiments, the ESP motor 113 of the electric submersible pump 112 includes at least one sensor 158 and power is transmitted through the system 100 to power the ESP motor 113. In some embodiments, a signal is impressed upon the power transmitted to provide a communications link between the electric submersible pump sensor(s) 158 and surface system(s) 160. In some embodiments, a wet-mate umbilical (not shown) is pumped to the electric submersible pump 112 through the tubing string 124 forming a dedicated communications link and/or additional conductive path. This wet-mate umbilical may also have an internal fluid injection line with an outlet valve or valves that allows reverse circulation of the flowable conductive material.

In operation, produced fluids enter the well 114 at perforations 136, pass through the production tubing 118, and enters inlet 138 of electric submersible pump 112, and are discharged at outlet 140 into the annulus B' formed by the inner surface 142 of production tubing 118 and exterior surface 129 of wall 128 of tubing string 124, exiting at the surface. Seal 144 is installed to direct produced fluids to inlet 138 of electric submersible pump 112.

Referring now to FIG. 3, a schematic view of an illustrative, nonexclusive example of a system 200 for deploying and powering an electric submersible pump 212 within a subterranean well 214 is shown. Subterranean well 214 includes a casing 216.

The system 200 includes a tubing string 224, which may be formed from an internally insulated coiled tubing 226. In some embodiments, internally insulated coiled tubing 226 may be formed so as to have an insulated coating 227 applied to the internal surface of coiled tubing 226. Tubing string 224 includes a wall 228, which forms a hollow interior 230. One end 232 of the tubing string 224 is connected to the electric submersible pump 212. The interior surface 220 of the casing 216 and the exterior surface 229 of wall 228 of the tubing string 224 serve to define an annular space A".

To provide power to the electric submersible pump 212, a flowable conductive material 250 may be placed so as to at least partially fill the hollow interior 230 of the tubing string 224. As will be described in more detail below, the flowable conductive material 250 may form a first conductive path 252. In some embodiments, tubing string 224 serves as a second conductive path 254, the first conductive path 252 and the second conductive path 254, formed by the conductive wall 228 of the tubing string 224, creating a circuit for supplying power to the electric submersible pump 212.

In some embodiments, the flowable conductive material 250 is selected from lead shot, graphite, mercury, copper, aluminum, or a combination thereof. The flowable conductive material 250 is pumped into the tubing string 224, either during installation or after landing. A filter/screen and/or check valve 262 at the bottom of the tubing string 224 may be employed to provide a flow path to annulus A", preventing the flowable conductive material 250 from escaping and providing injection point(s) for reverse circulation of the flowable conductive material.

In some embodiments, the electric submersible pump 212 has an intake 238 and an outlet or discharge 240. In some embodiments, the electric submersible pump 212 may be landed in the casing 216, to seal the intake 238 from the discharge 240.

In some embodiments, the ESP motor 213 is selected from a two-phase AC ESP motor or a DC ESP motor. In some embodiments, the system 200 includes a downhole DC-to-AC inverter 256 for powering a three-phase AC ESP motor. In some embodiments, the system 200 may also include a third conductive path to power a three-phase AC ESP motor.

In some embodiments, the electric submersible pump 212 includes at least one sensor 258 and power is transmitted through the system 200 to power the electric submersible pump 212. In some embodiments, a signal is impressed upon the power transmitted to provide a communications link between the electric submersible pump sensor(s) 258 and surface system(s) 260. In some embodiments, a wet-mate umbilical (not shown) is pumped to the electric submersible pump through the tubing string forming a dedicated communications link and/or additional conductive path. This wet-mate umbilical may also have an internal fluid injection line with an outlet valve or valves that allows reverse circulation of the flowable conductive material.

In operation, produced fluids enter the well 214 at perforations 236 and enters inlet 238 of electric submersible pump 212, and is discharged at outlet 240 into the annulus A" formed by the inner surface 220 of the casing 216 and exterior surface 229 of wall 228 of tubing string 224, exiting at the surface. Seal 244 is installed to seal the intake 238 from the discharge 240 of electric submersible pump 212.

As disclosed herein, the flowable conductive material may form a first conductive path. The following table lists resistivity calculations for a 1¾", 0.102" wall; 10,000 foot coiled tubing string, assuming a 2120V, 62 A pump motor.

The lead, mercury, and graphite calculations assume that the conductor fills the entire coiled tubing, while the steel calculation assumes the entire cross-sectional area of the coiled tubing serves as the conductor. Note that the resistance of a 10,000 foot, No. 2 AWG cable is 2.9Ω at 62 A. A comparison of resistivity and resistance for various materials is shown below.

TABLE 1

Resistivity and Resistance Values for Selected Flowable Conductors

| Material | Resistivity μΩ-in | Resistance Ω |
|---|---|---|
| Lead | 8.1 | 0.5 |
| Mercury | 38.7 | 2.5 |
| Graphite/Cu | 100 | 6.4 |
| Graphite | 500 | 32.0 |
| Steel CT | 5.9 | 1.3 |

As is known by those skilled in the art, electric submersible pump sensor data is typically communicated via a modulated signal layered upon an AC power transmission. As noted above, a similar scheme may be employed in the electrical arrangements disclosed herein. In some embodiments, a small umbilical may be pumped into the coiled tubing after landing and wet-mated to the electric submersible pump assembly. This line could serve as a dedicated sensing cable, as well as provide other benefits. The wet-mating operation can be performed with existing logging tools and could be undertaken before a flowable conductor was pumped into the tubing string.

A deep-set surface-controlled subsurface safety valve (SCSSV) and/or fluid loss control valve could be placed in the lower completion to provide an additional well control barrier during equipment installation and retrieval. Permanent sensors may be placed in the completion to relay equipment operational parameters to facility personnel. This information would assist the operators in monitoring, optimizing, troubleshooting, and improving the operating lifetime of the equipment. Corrosion/scale inhibitor, demulsifier, and/or other chemicals could be injected through a mandrel below the pump to improve production performance.

Referring to FIG. 4, in another aspect, provided is a method for deploying and powering an electric submersible pump within a subterranean well 400. The method includes 402, providing a tubing string having a wall forming a hollow interior; 404, connecting the tubing string to the electric submersible pump; 406, positioning the tubing string and electric submersible pump within the subterranean well; 408, flowing a flowable conductive material to at least partially fill the hollow interior of the tubing string, the flowable conductive material forming a first conductive path; 410, providing a second conductive path; and 412, forming a circuit for supplying power to the electric submersible pump, the circuit comprising the first conductive path and the second conductive path.

In some embodiments, the subterranean well includes a casing and production tubing positioned within the casing, the interior surface of the casing and the exterior surface of the production tubing defining an annular space. In some embodiments, the tubing string comprises a non-conductive composite material. In some embodiments, the production tubing forms the second conductive path. In some embodiments, the tubing string comprises a conductive metallic material, the inner surface of which is coated with an insulating, non-conductive material, the tubing string forming the second conductive path. In some embodiments, the flowable conductive material is selected from lead shot, graphite, mercury, copper, aluminum, or a combination thereof.

In some embodiments, the method 400 includes 414, providing a downhole DC-to-AC inverter for powering a three-phase AC ESP motor.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

In the event that any patents, patent applications, or other references are incorporated by reference herein and define a term in a manner or are otherwise inconsistent with either the non-incorporated portion of the present disclosure or with any of the other incorporated references, the non-incorporated portion of the present disclosure shall control, and the term or incorporated disclosure therein shall only control with respect to the reference in which the term is defined and/or the incorporated disclosure was originally present.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

It is within the scope of the present disclosure that an individual step of a method recited herein may additionally or alternatively be referred to as a "step for" performing the recited action.

Illustrative, non-exclusive examples of apparatus, systems and methods according to the present disclosure have been presented. It is within the scope of the present disclosure that an individual step of a method recited herein, may additionally or alternatively be referred to as a "step for" performing the recited action.

INDUSTRIAL APPLICABILITY

The apparatus and methods disclosed herein are applicable to the oil and gas industry.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

The invention claimed is:

1. A system for deploying and powering an electric submersible pump within a subterranean well, the system comprising:

(a) a tubing string having a wall forming a hollow interior, one end of the tubing string connected to the electric submersible pump;

(b) a flowable conductive material at least partially filling the hollow interior of the tubing string, the flowable conductive material forming a first conductive path; and (c) a second conductive path, wherein the first conductive path and the second conductive path form a circuit for supplying power to the electric submersible pump.

2. The system of claim 1, wherein the subterranean well comprises a casing and production tubing positioned within the casing, the interior surface of the casing and the exterior surface of the production tubing defining an annular space.

3. The system of claim 2, wherein the tubing string comprises a non-conductive composite material.

4. The system of claim 3, wherein the production tubing forms the second conductive path.

5. The system of claim 1, wherein the tubing string comprises a conductive metallic material, the inner surface of which is coated with an insulating, non-conductive material.

6. The system of claim 5, wherein the tubing string forms the second conductive path.

7. The system of claim 1, wherein the flowable conductive material is selected from lead shot, graphite, mercury, copper, aluminum, or a combination thereof.

8. The system of claim 1, wherein the electric submersible pump has an intake and a discharge and is landed in the production tubing or casing of the subterranean well to seal the intake from the discharge and provide a return electrical conduit.

9. The system of claim 1, wherein the electric submersible pump includes an ESP motor, the ESP motor selected from a two-phase AC ESP motor or a DC ESP motor.

10. The system of claim 1, further comprising a downhole DC-to-AC inverter for powering a three-phase AC ESP motor.

11. The system of claim 1, further comprising a third conductive path to power a three-phase AC ESP motor.

12. The system of claim 1, wherein the subterranean well comprises a casing which forms an annulus with the tubing string, the tubing string having a filter, a screen, or a check valve to allow a flow path to and from the annulus and provide at least one injection point for reverse circulation of the flowable conductive material, wherein the flowable conductive material is prevented from escaping.

13. The system of claim 1, wherein the electric submersible pump includes at least one sensor and power is transmitted through the system to power the electric submersible pump.

14. The system of claim 13, wherein a signal is impressed upon the power transmitted to provide a communications link between the electric submersible pump sensors and surface systems.

15. The system of claim 1, further comprising a wet-mate umbilical pumped to the electric submersible pump through the tubing string forming a dedicated communications link and/or additional conductive path.

16. The system of claim 15, wherein the wet-mate umbilical includes an internal fluid injection line having at least one outlet valve to permit reverse circulation of the flowable conductive material.

17. A method for deploying and powering an electric submersible pump within a subterranean well, the method comprising:

providing a tubing string having a wall forming a hollow interior;

connecting the tubing string to the electric submersible pump;

positioning the tubing string and electric submersible pump within the subterranean well;

flowing a flowable conductive material to at least partially fill the hollow interior of the tubing string, the flowable conductive material forming a first conductive path;

providing a second conductive path; and forming a circuit for supplying power to the electric submersible pump, the circuit comprising the first conductive path and the second conductive path.

18. The method of claim 17, wherein the subterranean well comprises a casing and production tubing positioned within the casing, the interior surface of the casing and the exterior surface of the production tubing defining an annular space.

19. The method of claim 18, wherein the tubing string comprises a non-conductive composite material.

20. The method of claim 19, wherein the production tubing forms the second conductive path.

21. The method of claim 17, wherein the tubing string comprises a conductive metallic material, the inner surface of which is coated with a insulating, non-conductive material, the tubing string forming the second conductive path.

22. The method of claim 17, wherein the flowable conductive material is selected from lead shot, graphite, mercury, copper, aluminum, or a combination thereof.

23. The method of claim 17, further comprising providing a downhole DC-to-AC inverter for powering a three-phase AC ESP motor.

* * * * *